US006085150A

United States Patent [19]

Henry et al.

[11] Patent Number: 6,085,150

[45] Date of Patent: Jul. 4, 2000

[54] TRAFFIC COLLISION AVOIDANCE SYSTEM

[75] Inventors: Jeff M. Henry; James M. Suiter, both of Cedar Rapids, Iowa

[73] Assignee: Rockwell Collins, Inc., Cedar Rapids, Iowa

[21] Appl. No.: 08/898,661

[22] Filed: Jul. 22, 1997

[51] Int. Cl.[7] ..... G08G 5/04

[52] U.S. Cl. ..... 701/301; 340/961; 342/29

[58] Field of Search ..... 701/1, 3, 4, 14, 701/120, 300, 301, 302; 340/903, 945, 961; 342/29, 455

[56] References Cited

U.S. PATENT DOCUMENTS 5,227,786 7/1993 Hancock ..... 340/961

*Primary Examiner*—William A. Cuchlinski, Jr.

*Assistant Examiner*—Edward Pipala

*Attorney, Agent, or Firm*—Nathan O. Jensen; Kyle Eppele; J. P. O'Shaughnessy

[57] ABSTRACT

A traffic collision avoidance system (TCAS) for use in a first aircraft is disclosed. The TCAS includes TCAS circuitry providing output data as a function of a location of an intruder aircraft relative to a location of the first aircraft. A display device coupled to the TCAS circuitry receives the output data. The display device is adapted to provide a graphical representation of the altitude of the intruder aircraft.

19 Claims, 4 Drawing Sheets

TRAFFIC COLLISION AVOIDANCE SYSTEM

CROSS REFERENCE TO RELATED APPLICATIONS

This application relates to a patent application entitled "A FLIGHT MANAGEMENT SYSTEM WITH 3-DIMENSIONAL FLIGHT PATH DISPLAY" by James M. Suiter and Gary L. Owen, U.S. application Ser. No. 08/724,533, filed on Sep. 30, 1996 and issued on Jul. 6, 1999 as U.S. Pat. No. 5,920,321, and to a patent application entitled "AUTOMATIC VIEW ADJUSTING FLIGHT PLAN DISPLAY", by Gary L. Owen, James M. Suiter and Jeff M. Henry, U.S. application Ser. 08/723,405, filed on Sep. 30, 1996.

FIELD OF THE INVENTION

The present invention generally relates to Traffic Alert and Collision Avoidance System (TCAS) displays. More particularly, the present invention relates to a TCAS display with a graphical representation of the altitude of intruder aircraft.

BACKGROUND OF THE INVENTION

In recent years, avionics engineers have endeavored to provide pilots and flight crews with information necessary for safe flight. One approach has been to provide the flight crew with information on the location of other aircraft in the vicinity. The systems which provide this information, known as TCAS, are required for all airliners flying in United States air space. TCAS devices interrogate transponders of other aircraft, sometimes referred to as "intruder" aircraft. The TCAS then evaluates the threat of collision with the other aircraft and coordinates an escape for the aircraft.

Existing TCAS display devices provide the flight crew with a top view representation or format which graphically displays the distance and bearing of the intruder aircraft. Intruder altitude information, relative to a reference altitude, is provided numerically. Thus, the pilot must form his or her own mental picture of the relative altitude differences between the altitude of his or her aircraft and the current altitude of the intruder aircraft. Because this single view TCAS display format requires that the pilot interpret the display both graphically and numerically at the same time, the pilot's situational awareness is not optimal. This fact increases the chance that pilot error will cause a mid-air collision. Further, with the pilot's situational awareness reduced, other pilot errors can occur.

SUMMARY OF THE INVENTION

It is an object of the present invention to provide an enhanced TCAS display which increases the pilot's situational awareness.

It is a feature of the present invention to provide 2-dimensional and 3-dimensional TCAS display representations in which the pilot is provided a graphical representation of the altitude of air traffic.

It is another feature of the present invention to provide a TCAS display in which the graphical representation of air traffic can be rotated and/or tilted to provide the pilot the most useful view possible.

A TCAS for use in a first aircraft is disclosed. The TCAS includes TCAS circuitry providing output data as a function of a location of an intruder aircraft relative to a location of the first aircraft. A display device coupled to the TCAS circuitry receives the output data. The display device is adapted to provide a graphical representation of the altitude of the intruder aircraft.

BRIEF DESCRIPTION OF THE DRAWINGS

The invention may be more fully understood by reading the following description of a preferred embodiment of the invention, in conjunction with the appended drawings wherein.

DETAILED DESCRIPTION OF THE PREFERRED EMBODIMENTS

Figure 1:
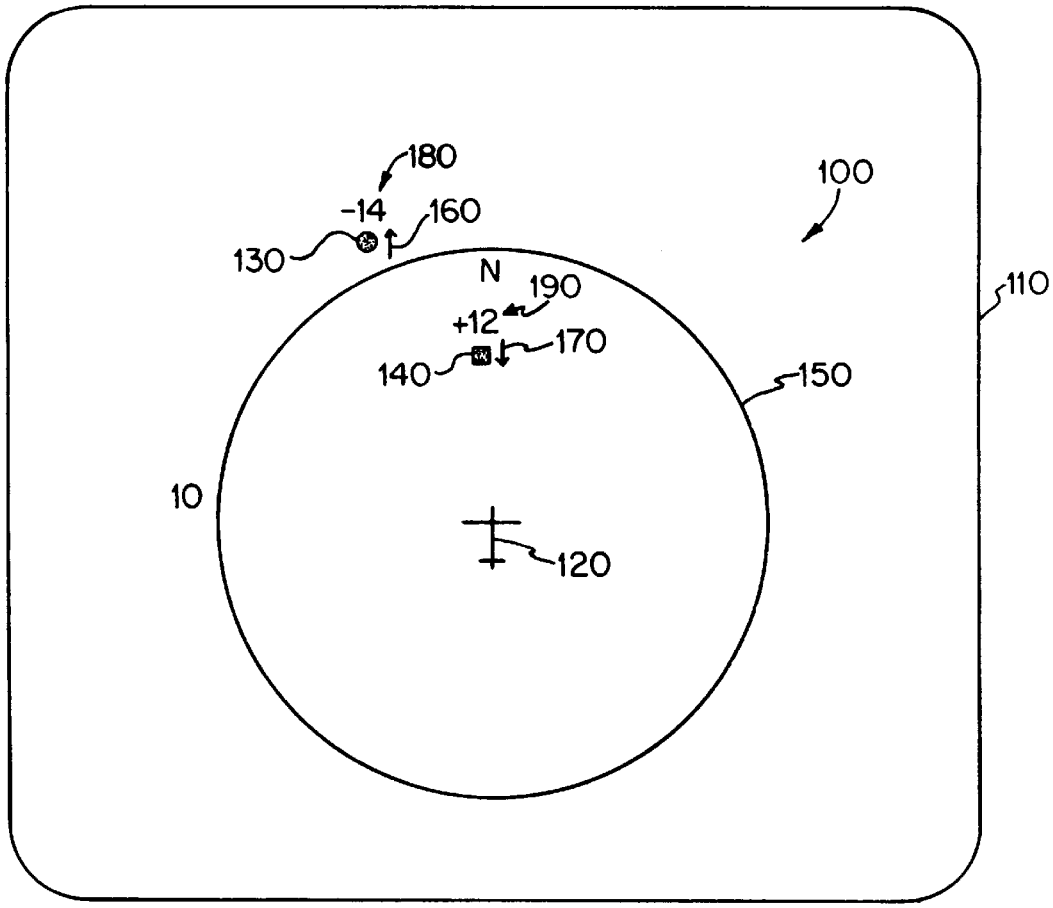
Fig. 1 PRIOR ART
FIG. 1 is a typical 2-dimensional top representation of intruder aircraft information which is a prior art TCAS display format and which is one of multiple TCAS display formats selectable in the TCAS displays of the present invention.

Now referring to the drawings, where like numerals refer to like matters throughout, and more particularly to FIG. 1, there is shown a diagrammatic illustration of a TCAS display device or display unit 110 providing a conventional 2-dimensional top view or representation of TCAS information. As such, 2-dimensional top representation 100 generated by display device 110 includes graphical representation 120 of the aircraft in which display device 110 is installed, graphical representation 130 of a first intruder aircraft, graphical representation 140 of a second intruder aircraft, range ring 150 indicating a reference distance from the location of aircraft 120, arrow 160 indicating a direction of vertical travel (i.e., ascending or descending) of intruder aircraft 130, arrow 170 indicating a direction of vertical travel of intruder aircraft 140, numeric altitude representation 180 indicating an altitude of intruder aircraft 130 relative to a reference altitude, and numeric altitude representation 190 indicating an altitude of intruder aircraft 140 relative to the reference altitude.

2-dimensional top representation 100 provided by display device 110 is the type of TCAS display format conventionally provided to pilots of aircraft 120 in which display device 110 is installed. In preferred embodiments of the present invention, 2-dimensional top representation 100 can be selectively provided by display device 110, at the pilot's option, but is not the preferred representation of TCAS information.

When viewing representation 100 as illustrated in FIG. 1, the pilot of aircraft 120 can see intruder aircraft 130 to the left of the direction of travel of aircraft 120, and intruder aircraft 140 substantially straight ahead in the direction of travel of aircraft 120. Arrow 160 provides an indication to the pilot of aircraft 120 that intruder aircraft 130 is ascending, while arrow 170 provides an indication to the pilot that intruder aircraft 140 is descending. However, to determine the relative altitudes of intruder aircraft 130 and 140, the pilot must interpret numeric altitude representations 180 and 190. As illustrated, numeric altitude representation 180 informs the pilot of aircraft 120 that intruder aircraft 130 is flying at an altitude which is approximately 1,400 feet below a reference altitude. The reference altitude can be, for example, the current altitude of aircraft 120. Numeric representation 190 informs the pilot that intruder aircraft 140 is currently flying at an altitude which is approximately 1,200 feet above the reference altitude. Since 2-dimensional TCAS representation 100 requires the pilot to form his or her own mental picture of the relative altitude differences between the expected altitude of aircraft 120 and the current altitudes of intruder aircraft 130 and 140, the pilot's situational awareness is adversely affected.

Figure 2:
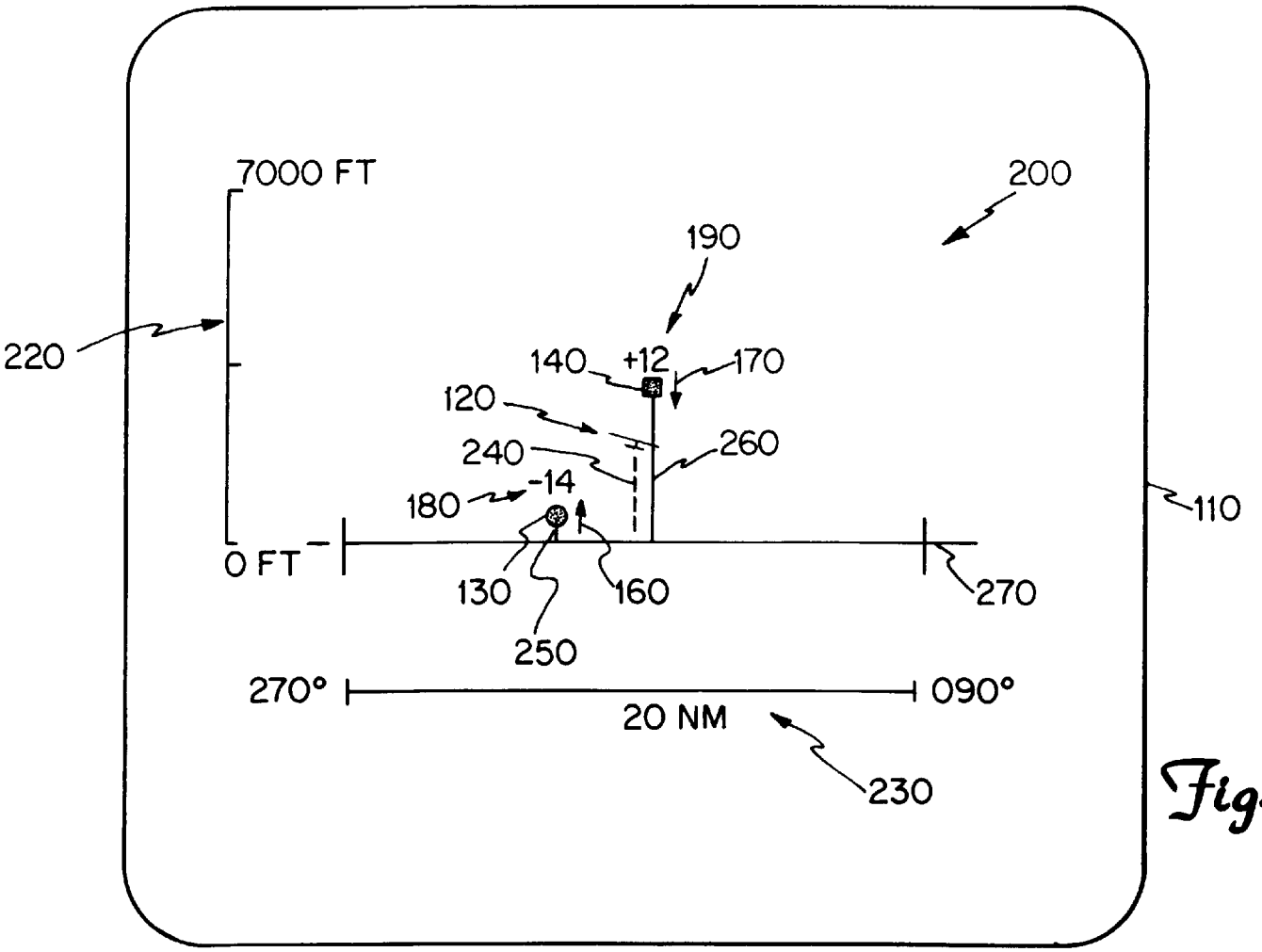
FIG. 2 is a 2-dimensional representation, orthogonal to the representation illustrated in FIG. 1, illustrating intruder aircraft altitude information both graphically and numerically in order to optimize the pilot's situational awareness, which is selectably displayed by the TCAS displays of the present invention.

FIG. 2 illustrates TEAS display device 110 providing 2-dimensional side view representation 200 of TCAS intruder aircraft information. Representation 200 is a view which is orthogonal to the view in representation 100. In preferred embodiments, representation 200 is selectably provided by display device 110. On the left side of representation 200 provided by display device 110 is altitude scale 220 which, as shown, ranges from zero feet to 7,000 feet. However, the range of altitude scale 220 can be varied as necessary and does not necessarily begin at zero feet. As will discussed below in greater detail, the lowest altitude indicated on scale 220 will preferably be used as a reference altitude for use in graphically displaying the relative altitudes of intruder aircraft 130 and 140. Scale 230 is a side view range ring which provides directional or bearing information in a manner similar to that provided by range ring 150 illustrated in FIG. 1.

Representation 200 provided by display device 110 illustrates much of the same type of information illustrated by representation 100 shown in FIG. 1. Like representation 100, representation 200 illustrates general locations of intruder aircraft 130 and 140 relative to the current location of aircraft 120, and includes arrows 160 and 170 to indicate whether intruder aircraft 130 and 140 are ascending or descending. Further, like representation 100, representation 200 optionally includes numeric representations 180 and 190 of the altitudes of intruder aircraft 130 and 140, respectively, relative to a reference altitude.

2-dimensional representation 200 provided by display device 110 differs in a substantial manner from 2-dimensional top representation 100 in that it includes graphical representations of the relative altitudes of intruder aircraft 130 and 140 in order to increase the situational awareness of the pilot of aircraft 120 viewing display device 110. As illustrated, dashed line segment 240 extends from the graphical representation of aircraft 120 down to a reference altitude 270, which is zero feet in the example illustrated. It should be noted that the reference altitude for numeric altitude representations 180 and 190 (which is typically the altitude of aircraft 120) is not typically the same as the reference altitude 270 at which line segment 240 terminates (typically zero feet). Line segment 250 extends from the graphical representation of intruder aircraft 130 down to the reference altitude 270. Line segment 260 extends from the graphical representation of intruder aircraft 140 down to the reference altitude 270. Thus, line segments 240, 250 and 260 provide a graphical representation of altitude information which is more easily interpreted by the pilot.

In preferred embodiments, the relative lengths of dashed line segment 240 and line segments 250 and 260 are substantially proportional to the altitudes of the corresponding aircraft relative to the reference altitude 270. Therefore, with intruder aircraft 130 having an altitude which is 1,400 feet below the current altitude of aircraft 120, the length of line segment 250 is provided such that it is proportionally less than the length of dashed line segment 240. Likewise, since intruder aircraft 140 has an altitude which is approximately 1,200 feet greater than that of aircraft 120, line segment 260 is provided such that it is proportionally longer than dashed line segment 240. Therefore, the pilot of aircraft 120 in which display device 110 is installed is provided a graphical representation of the altitudes of intruder aircraft 130 and 140 relative to the current altitude of aircraft 120. With the 2-dimensional graphical representation of the location(s) of the intruder aircraft, including the graphical representation of the intruder aircraft altitudes, the pilot can more easily build a mental picture of the air traffic situation. Therefore, the pilot's situational awareness is increased, thereby reducing the likelihood of a pilot related error occurring.

Figure 3:
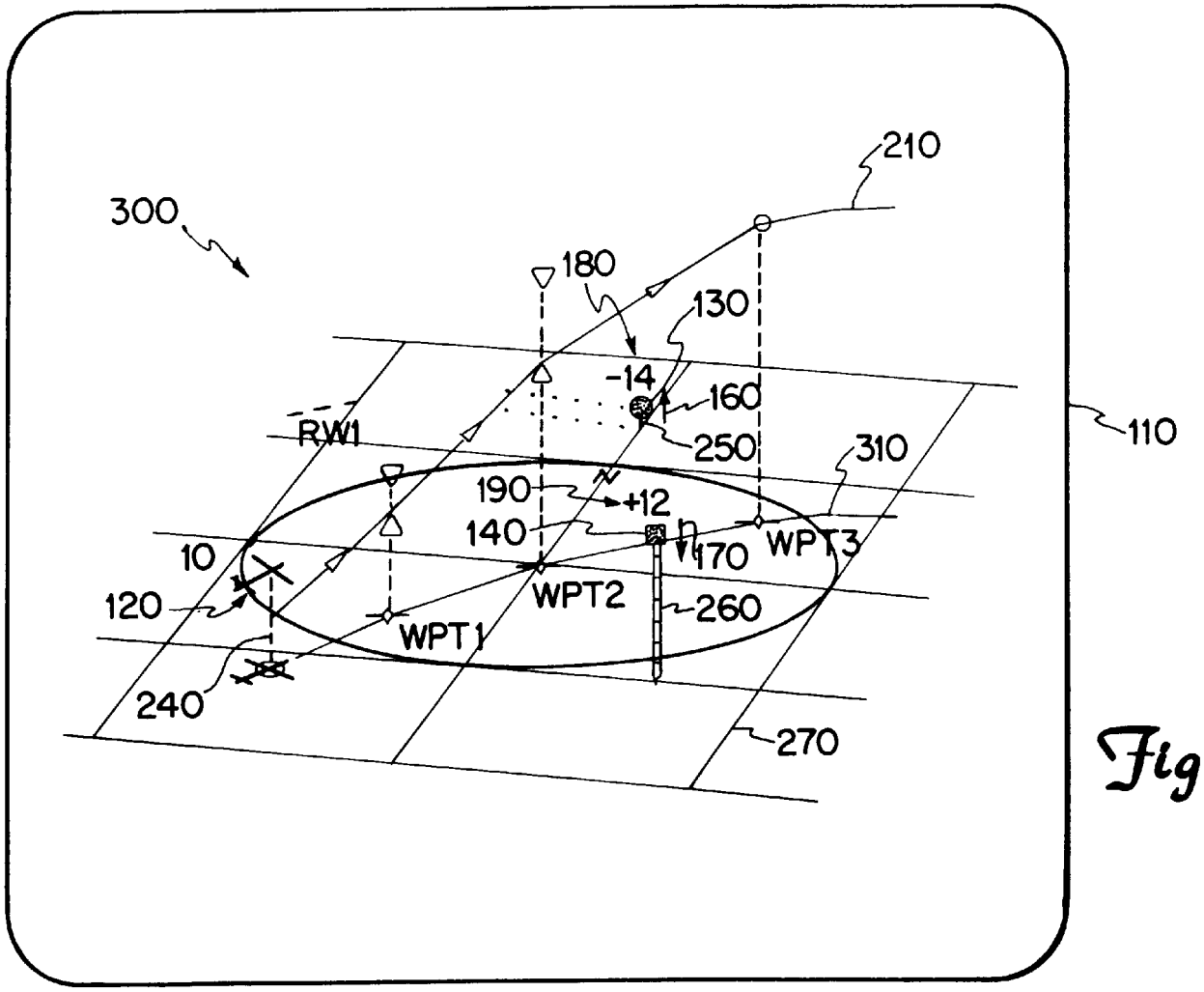
FIG. 3 is a shoulder view representation, illustrating intruder aircraft altitude information both graphically and numerically in order to optimize the pilot's situational awareness, which is selectably displayed by the TCAS displays of the present invention.

FIG. 3 illustrates TCAS display device 110 providing 3-dimensional shoulder view representation 300 of TCAS intruder aircraft information. Like representations 100 and 200, in preferred embodiments, representation 300 is selectably provided by display device 110 for viewing by the pilot of aircraft 120. Like representations 100 and 200, representation 300 provides a graphical representation or illustration of aircraft 120 and intruder aircraft 130 and 140. Likewise, representation 300 includes arrows 160 and 170 which provide a graphical representation of whether the intruder aircraft are ascending or descending.

Like representation 200, representation 300 also includes line segments 240, 250 and 260, which act as graphical representations of the relative altitudes of aircraft 120 and intruder aircraft 130 and 140. Further, representation 300 includes graphical representations or illustrations of flight plan or path 210 which includes flight path altitude information, and flight plan or path 310 which is essentially the same as flight plan or path 210 except that it does not include altitude information and therefore lies completely in the plane of grid 270. Grid 270 represents the reference altitude discussed above at which line segments 240, 250 and 260 terminate, which in some embodiments is zero feet. Like representations 100 and 200, representation 300 also includes numeric representations 180 and 190 of the relative altitudes of intruder aircraft 130 and 140 as compared to the altitude of aircraft 120.

In preferred embodiments of the present invention, the pilot of aircraft 120 can control display device 110 such that it provides as a display output any of a variety of TCAS intruder aircraft representations, views or formats including 2-dimensional top and side representations 100 and 200, respectively, and 3-dimensional representation 300. Further, other 2-dimensional and 3-dimensional views or representations of the TCAS intruder aircraft information are possible.

Figure 4:
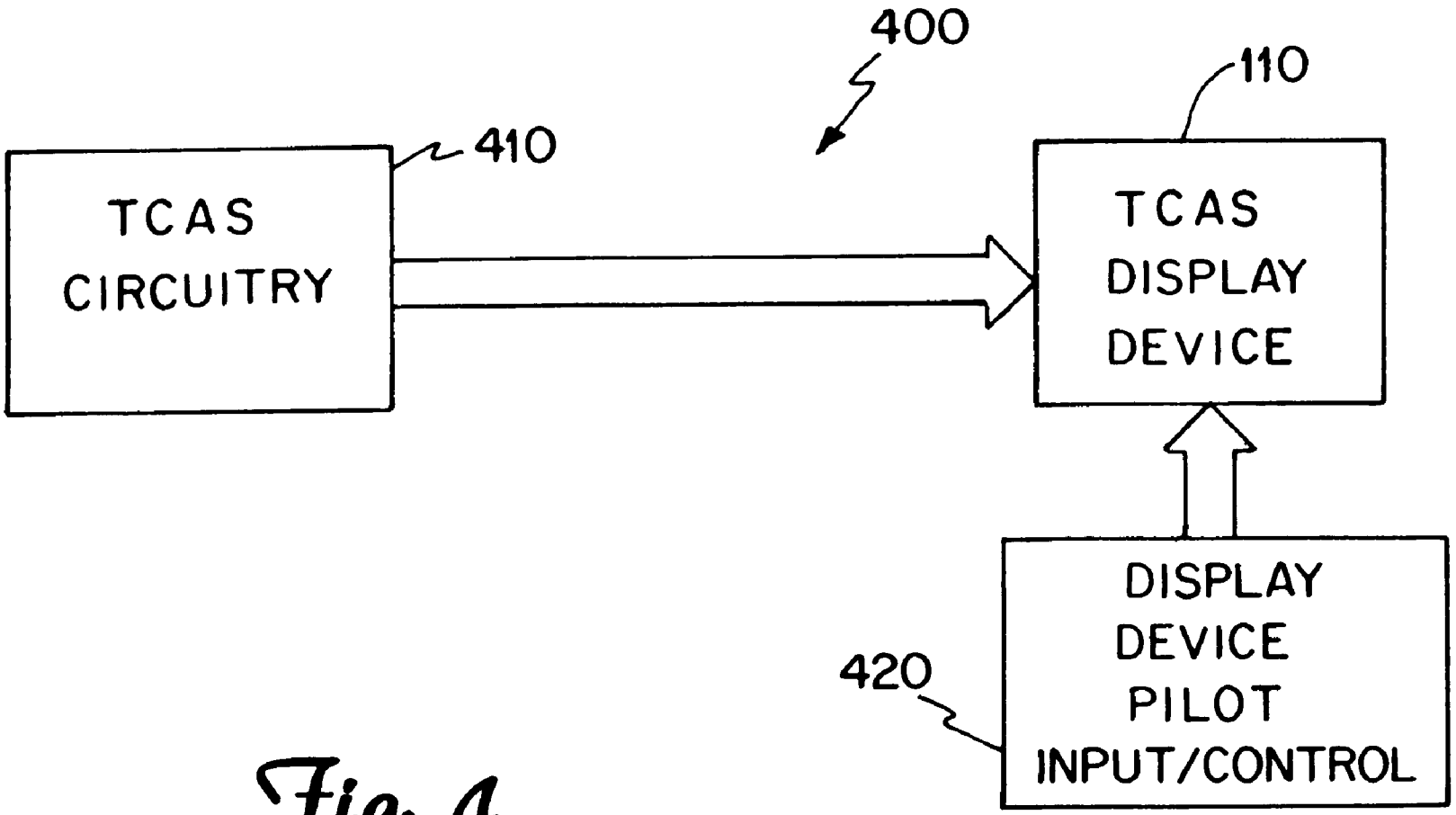
FIG. 4 is a block diagram of a TCAS and a TCAS display device, in accordance with the present invention, which provides in one or more display formats, graphical representations of the altitude of air traffic.

FIG. 4 is a block diagram of a TCAS 400 for use in aircraft 120. TCAS 400 includes TCAS circuitry 410, TCAS display device 110 and display device pilot input/control or interface 420. TCAS circuitry 410 is preferably a TCAS line replaceable unit (LRU) of the type which are well known in the aviation industry and available from multiple avionics manufacturers. TCAS circuitry 410 is in many cases required to be installed in aircraft by United States law. TCAS circuitry 410 provides as an output TCAS data which is indicative of the location of intruder aircraft 130 and 140 in the vicinity of aircraft 120 in which TCAS 400 is installed.

TCAS display device 110 can be any of a wide variety of display devices common in the avionics industry. For example, TCAS display device 110 can be a cathode ray tube (CRT) display or a liquid crystal display (LCD). TCAS display device 110 is controlled in a known manner to generate visual representations based upon control or data signals provided to the display device. While in preferred embodiments of the present invention TCAS display device 110 provides advantages over the prior art in that it generates multiple 2-dimensional and 3-dimensional representations of TCAS intruder aircraft information, those skilled in the art will recognize that known display driver or control techniques can be used to generate the representations in accordance with the present invention.

Display device pilot input/control 420 is a pilot interface device located either on TCAS display device 110, or elsewhere in the cockpit of the aircraft. Interface 420 can be, for example, a toggle switch, a push button type switch, a rotating knob type switch, or any other suitable interface device. Using interface 420, the pilot of aircraft 120 can selectively control which of multiple TCAS intruder aircraft representations are provided by display device 110. In preferred embodiments, display device 110 displays the TCAS information using a 2-dimensional format such as representation 200 and/or using a 3-dimensional format such representation 300. Thus, the pilot can choose a TCAS display representation or format which optimizes the pilot's situational awareness.

Although the present invention has been described with reference to preferred embodiments, workers skilled in the art will recognize that changes may be made in form and detail without departing from the spirit and scope of the invention. It should be noted that relative positons of the intruder aircraft relative to aircraft 120 are in different locations in each representations 100, 200 and 300.

What is claimed is:

1. A traffic collision avoidance system (TCAS) for use in a first aircraft, the TCAS comprising:

TCAS circuitry providing output data as a function of a location of an intruder aircraft relative to a location of the first aircraft; and A display device coupled to the TCAS circuitry and receiving the output data, the display device being adapted to provide a graphical representation of an altitude of the intruder aircraft, wherein the display device is adapted to selectable provide both the graphical representation of the altitude of the intruder aircraft and a numeric representation of the altitude of the intruder aircraft that changes as the relative altitude between the first aircraft and the intruder aircraft changes.

2. The TCAS of claim 1, wherein the display device is also adapted to selectably provide only the numeric representation of the altitude of the intruder aircraft.

3. The TCAS of claim 1, and further comprising a display device pilot interface coupled to the display device, wherein a pilot of the first aircraft uses the display device pilot interface to select which of multiple intruder aircraft representation formats is provided by the display device to thereby optimize the situational awareness of the pilot.

4. The TCAS of claim 1, wherein the display device is adapted to provide the graphical representation of the altitude of the intruder aircraft in combination with a graphical representation of the position of the intruder aircraft relative to the first aircraft.

5. The TCAS of claim 1, wherein the graphical representation of the altitude of the intruder aircraft is a graphical representation of an altitude of the intruder aircraft relative to first reference altitude.

6. The TCAS of claim 5, wherein the first reference altitude is approximately zero feet.

7. A traffic collision avoidance system (TCAS) for use in a first aircraft, the TCAS comprising:

TCAS circuitry Providing output data as a function of a location of an intruder aircraft relative to a location of the first aircraft; and a display device coupled to the TCAS circuitry and receiving the output data, the display device being adapted to provide a graphical representation of an altitude of the intruder aircraft in combination with a flight plan display.

8. A traffic collision avoidance system (TCAS) for use in a first aircraft, the TCAS comprising:

TCAS circuitry providing output data as a function of a location of an intruder aircraft relative to a location of the first aircraft; and a display device coupled to the TCAS circuitry and receiving the output data, the display device being adapted to provide a graphical representation of an altitude of the intruder aircraft relative to a first reference altitude, wherein the graphical representation of the altitude of the intruder aircraft includes a first line segment extending from a graphical representation of the intruder aircraft to the first reference altitude, wherein a relative length of the first line segment is indicative of the altitude of the intruder aircraft.

9. A traffic collision avoidance system (TCAS) for use in a first aircraft, the TCAS comprising:

TCAS circuitry providing TCAS data as a function of a given location of an intruder aircraft relative to a location of the first aircraft;

a display device operationally coupled to the TCAS circuitry and receiving the TCAS data, the display device adapted to provide a plurality of different graphical representations of the given location of the intruder aircraft, wherein each of the plurality of different graphical representations of the given location of the intruder aircraft has a different viewing perspective associated therewith; and a display device pilot interface operationally coupled to the display device, wherein a pilot of the first aircraft uses the display device pilot interface to select which of the plurality of different graphical representations of the given location of the intruder aircraft is displayed by the display device so that situational awareness of the pilot is optimized.

10. The TCAS of claim 9, wherein at least one of the plurality of different graphical representations of the location of the intruder aircraft includes a graphical representation of an altitude of the intruder aircraft relative to a first reference altitude.

11. The TCAS of claim 10, wherein the graphical representation of the altitude of the intruder aircraft relative to the first reference altitude includes a line segment extending from a graphical representation of the intruder aircraft to a representation of the first reference altitude, wherein a relative length of the line segment is representative of the altitude of the intruder aircraft.

12. The TCAS of claim 10, wherein at least one of the plurality of different graphical representations of the location of the intruder aircraft includes both a graphical representation of the altitude of the intruder aircraft relative to the first reference altitude and a numeric representation of the altitude of the intruder aircraft relative to a second reference altitude.

13. The TCAS of claim 10, wherein at least one of the plurality of different graphical representations of the location of the intruder aircraft includes a graphical representation of the altitude of the intruder aircraft relative to the first reference altitude in combination with a flight plan display.

14. A traffic collision avoidance system (TCAS) display unit for use in a first aircraft, the TCAS display unit comprising:

a display device adapted to receive TCAS data indicative of a given location of a second aircraft relative to the first aircraft and to provide a 3-dimensional representation of the location of the second aircraft relative to the first aircraft, wherein the display device is further adapted to provide a plurality of 3-dimensional representations of the given location of the second aircraft relative to the first aircraft; and a display device interface coupled to the display device and controlling which of the plurality of 3-dimensional representations of the given location of the second aircraft are provided by the display device, wherein a pilot of the first aircraft uses the display device interface to select which of the plurality of 3-dimensional representations are provided by the display device to thereby optimize the situational awareness of the pilot.

15. The TCAS display unit of claim 14, wherein at least one of the plurality of 3-dimensional representations of the location of the second aircraft relative to the first aircraft includes a graphical representation of an altitude of the second aircraft relative to a first reference altitude.

16. The TCAS display unit of claim 15, wherein in the at least one of the plurality of 3-dimensional representations of the location of the second aircraft, the graphical representation of the altitude of the second aircraft relative to the first reference altitude includes a first line segment extending from a graphical representation of the second aircraft to a representation of the first reference altitude, wherein a relative length of the first line segment is representative of the altitude of the second aircraft.

17. The TCAS display unit of claim 16, wherein the at least one of the plurality of 3-dimensional representations of the location of the second aircraft further includes a second line segment extending from a graphical representation of the first aircraft to the representation of the first reference altitude, wherein the length of the second line segment is indicative of the altitude of the first aircraft, and wherein a length of the first line segment relative to a length of the second line segment is representative of the altitude of the second aircraft relative to the altitude of the first aircraft.

18. The TCAS display unit of claim 15, wherein at least one of plurality of 3-dimensional representations of the location of the second aircraft relative to the first aircraft includes a combination of the graphical representation of the altitude of the second aircraft relative to a first reference altitude and a numeric representation of the altitude of the second aircraft that changes as the location of the second aircraft relative to the first aircraft changes.

19. The TCAS display unit of claim 15, wherein at least one of plurality of 3-dimensional representations of the location of the second aircraft relative to the first aircraft includes a combination of the graphical representation of the altitude of the second aircraft relative to a first reference altitude and a numeric representation of the altitude of the second aircraft relative to a second reference altitude.

* * * * *